United States Patent [19]

Perkins

[11] 4,000,902

[45] Jan. 4, 1977

[54] GOLF PUTTER WITH IN-LINE AIMING AND DIRECTIONAL CONTROL CAPABILITIES

[76] Inventor: Sonnie Joseph Perkins, 2320 186th Ave. NE., Redmond, Wash. 98052

[22] Filed: Jan. 15, 1976

[21] Appl. No.: 649,337

Related U.S. Application Data

[63] Continuation-in-part of Ser. No. 550,471, Feb. 18, 1975, abandoned.

[52] U.S. Cl. ..... 273/164; 273/167 A

[51] Int. Cl.[2] ..... A63B 53/00

[58] Field of Search ..... 273/77 R, 79, 80 C, 273/162–164, 167–175, 183 D, 186 R, 193 R, 194 R, 194 A

[56] References Cited

UNITED STATES PATENTS

| | | | |
|---|---|---|---|
| 2,995,375 | 8/1961 | Bukovey | 273/162 B |
| 3,138,386 | 6/1964 | Onions | 273/167 A |
| 3,459,426 | 8/1969 | Sherwood | 273/164 X |
| 3,841,641 | 10/1974 | Bennett | 273/164 |

FOREIGN PATENTS OR APPLICATIONS

| | | | |
|---|---|---|---|
| 328,823 | 5/1930 | United Kingdom | 273/163 R |
| 294,389 | 7/1928 | United Kingdom | 273/167 A |

OTHER PUBLICATIONS

"Golf Digest;" May 1965, p. 24.

*Primary Examiner*—Richard J. Apley
*Attorney, Agent, or Firm*—William W. Haefliger

[57] ABSTRACT

A golf putter that allows the golfer to effectively aim the putter blade from behind the ball while looking down the intended direction of roll of the ball and to maintain this established direction while the golfer is moving into the normal putting position.

9 Claims, 13 Drawing Figures

GOLF PUTTER WITH IN-LINE AIMING AND DIRECTIONAL CONTROL CAPABILITIES

BACKGROUND OF THE INVENTION

This application is a continuation-in-part of my copending application Ser. No. 550,471, filed Feb. 18, 1975, now abandoned.

Golfers utilizing conventional putters line up the putter blade by placing the blade at right angles to the intended direction of roll of the ball. The intended roll of the ball is usually established by visualizing an imaginary line from the ball to the hole, or an imaginary line from the ball to a spot on the line of intended roll. The putter blade is then set at right angles to this reference line.

Under the current state of the art, a golfer's putting ability depends largely on his ability to correctly establish the putter blade at right angles to this reference line; or to aim a score mark or directional mark that may be incorporated in the current designed putters parallel to the intended line of roll. Both of these methods are subject to much mechanical error.

SUMMARY OF THE INVENTION

The new putter concept of the present invention corrects many of these aiming problems. The putter is so constructed that when the putter is placed behind the ball and the handle of the putter lowered, with the golfer in a crouched position directly behind the ball, the incorporated aiming device or devices are substantially parallel to the ground and may be utilized to establish the direction of the blade in a simple, accurate and direct manner. Basically, the golf putter is embodied in the combination that includes:

a. A transversely horizontally elongated blade having a substantially vertical planar front face, a turf engaging bottom face located immediately rearwardly of the front face, and a rear face which extends arcuately rearwardly and upwardly above the level of said bottom face, said front face, bottom face and rear face each being transversely horizontally elongated, said rear face being generally convex downwardly and rearwardly to rotatably engage the turf in blade supporting relation as the blade is tilted rearwardly, and b. a putting path sighting device carried by the blade and projecting angularly upwardly and rearwardly relative thereto, said blade having a rearwardly tilted position in which the front face is elevated, said rear face supports the blade on the turf, and said device extends rearwardly and substantially horizontally.

As will appear, the sighting device (or devices) may advantageously be mounted on upper extent of the blade to define a linearly elongated line of sight which during blade tilting remains in an upright plane which perpendicularly intersects the planar front face; and the blade center of mass remains approximately vertically above the zone of engagement of the blade rear face with the turf, during such tilting. As a result, slippage of the blade during sighting is prevented, despite rather abrupt handling of the shaft, and very accurate aiming is enabled. Further, the blade rear face may include or carry outward projections, especially at transverse end portions of the blade, to grip the turf during tilting, and the blade may be centrally recessed, as will appear.

These and other objects and advantages of the invention, as well as the details of illustrative embodiments, will be more fully understood from the following description and drawings, in which:

DRAWING DESCRIPTION

DETAILED DESCRIPTION

Figure 1:
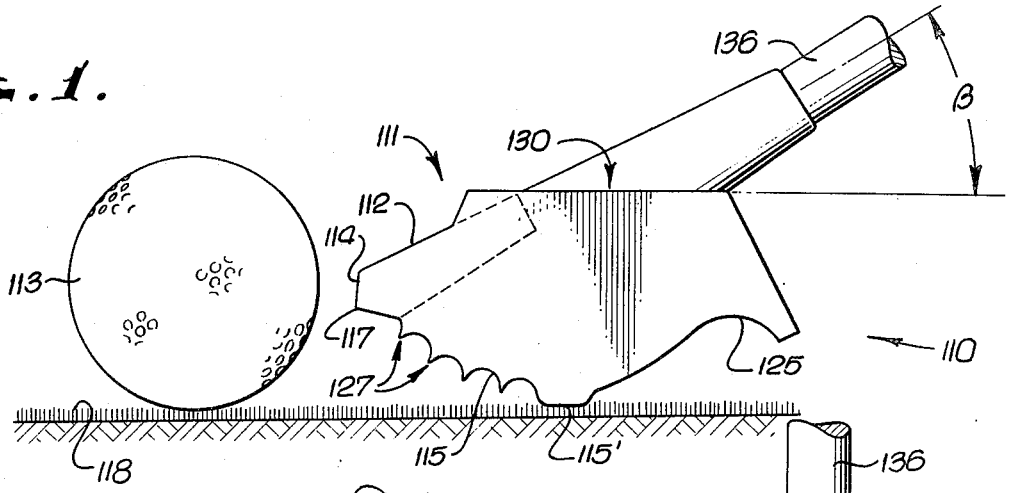
FIG. 1 is an end elevation of a putter head or blade in tilted aiming position.
Figure 2:
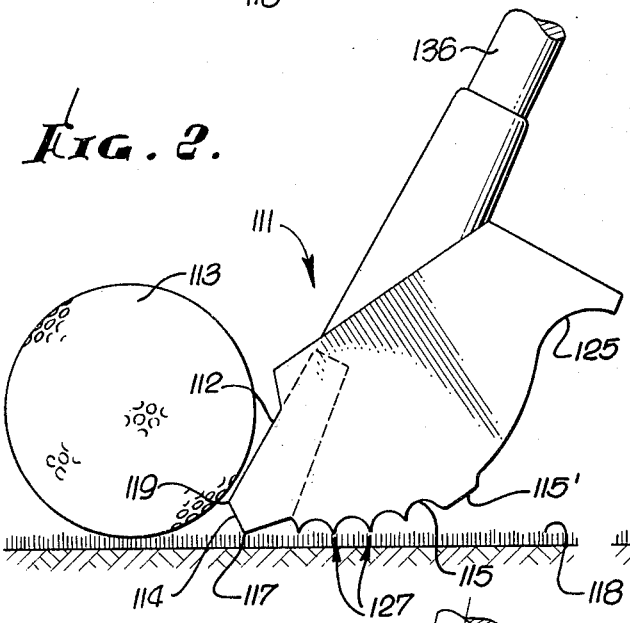
FIG. 2 is an end view like FIG. 1, but showing the blade being rotated toward normal putting position.
Figure 3:
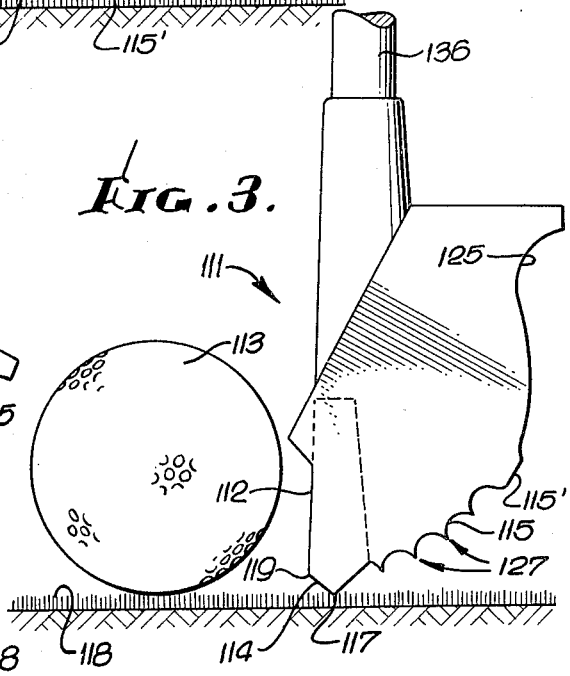
FIG. 3 is an end view like FIG. 1, but showing the blade in normal upright putting position.
Figure 5:
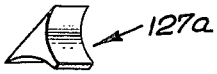
FIGS. 5–8 are isometric drawings showing various configurations of directional control projections.
Figure 4:
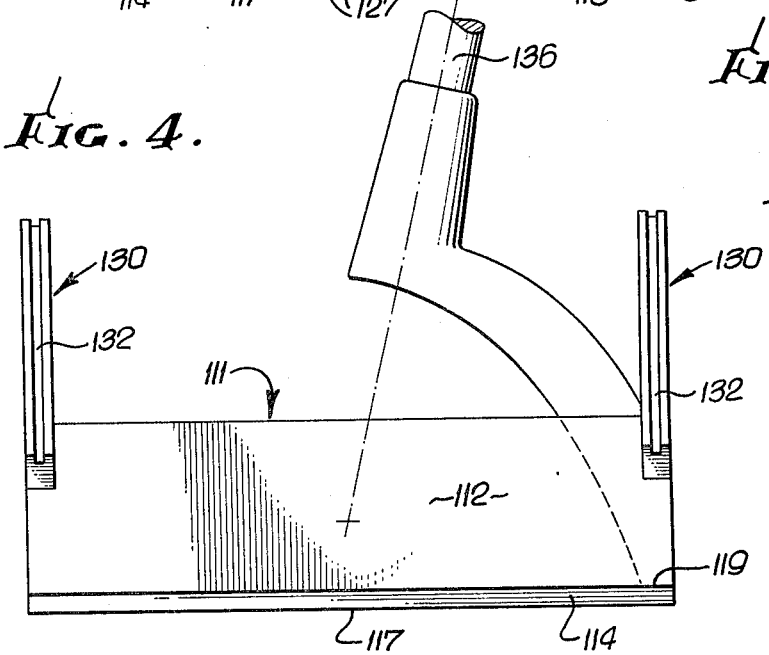
FIG. 4 is a frontal elevational view of the FIG. 3 position blade.
Figure 6:
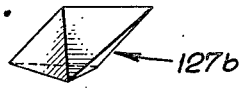
Figure 7:
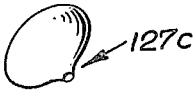
Figure 8:
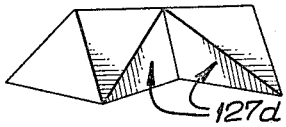

Referring first to FIGS. 9 and 11–13, the golf putter 10 includes a transversely horizontally elongated head or blade 11 having a planar front face 12 which extends vertically. In that position, the front face is adapted to be advanced to stroke the ball 13 toward the cup. The blade also has a turf engaging, narrow bottom face 14 immediately rearwardly of the front face, the bottom planar face extending rearwardly and downwardly at a small angle $\alpha$ from horizontal less than about 15°. Further, the blade or head has a rear face 15 which extends arcuately rearwardly and upwardly from the bottom face, there being a small step 16 between the forwardmost extent of rear face 15 and the rearwardmost edge 17 of bottom face 14, that step preventing inadvertent engagement of face 15 (or projections thereon) with the turf 18 upon stroking the ball or during the backswing just prior thereto. The angularity $\alpha$ also assures that the forward edge 19 of the bottom face will not inadvertently engage the turf upon such stroking or backswing. The blade also includes a horizontal top face or side 20, relieved at 21 and 22, and an auxiliary concave back face 23.

It will further be noted that faces 12, 14, 15, 20 and 23 are each transversely horizontally elongated; also, that rear lower face 15 is generally convex downwardly and rearwardly. This configuration enables rotatable engagement with the turf, as the blade is progressively tilted rearwardly, and without slippage; since the point or zone of engagement of the blade with the turf during such tilting remains approximately beneath the center of mass C of the blade, as appears in FIG. 10.

Figure 9:
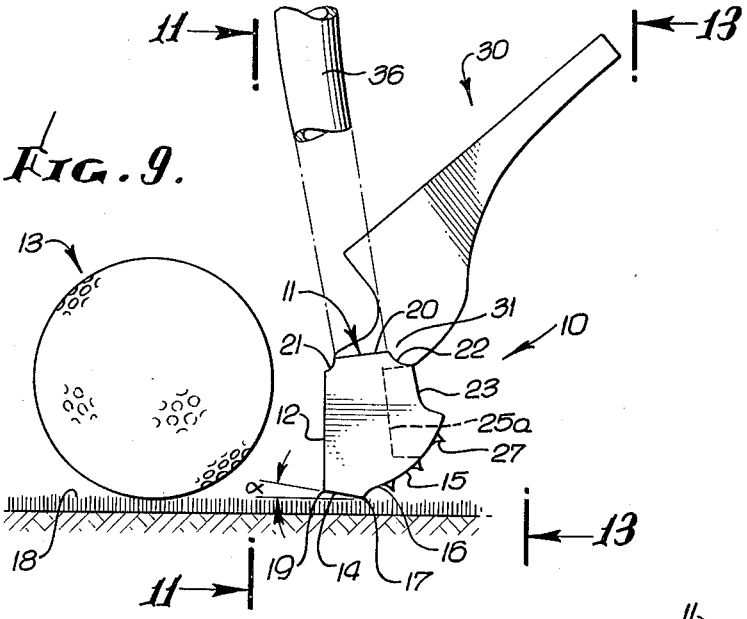
FIG. 9 is an end elevation of a modified putter head in upright putting position.
Figure 13:
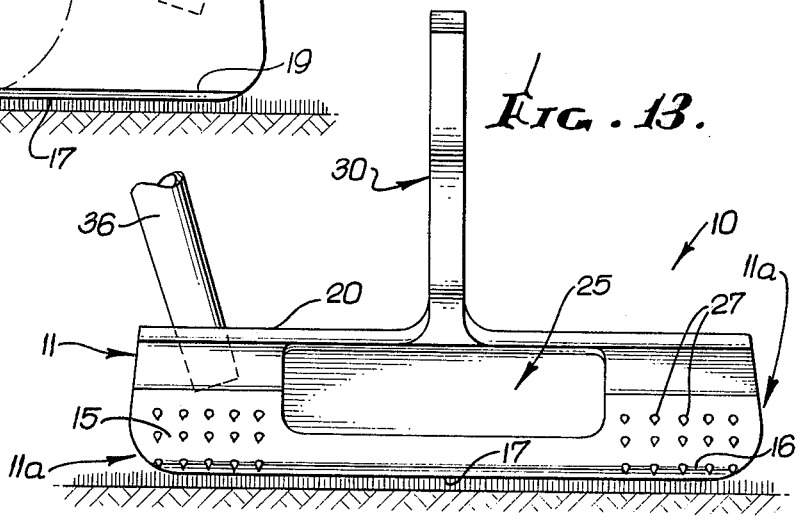
FIG. 13 is a rear elevation view of the modified blade taken on lines 13—13 of FIG. 9.

FIG. 13 shows that a recess 25 is sunk in the rear faces 15 and 23 of the blade, and in a forward direction, as is clear from the broken lines **25*a* in FIG. 9. The recess is located intermediate the transverse end portions 11*a* of the blade, and its transverse length is between about ⅓ to ⅔ the transverse overall length of the blade. Accordingly, the blade weight is substantially reduced, which is of importance considering that the blade typically consists of cast heavy metal such as bronze. The end portions 11*a* may carry integral turf engaging or gripping projections 27, which taper outwardly from the rear face or faces 15**, as shown. Such projections provide further assurance against transverse as well as forward and/or rearward slippage of the blade on and relative to the turf, during blade tilting.

Figure 10:
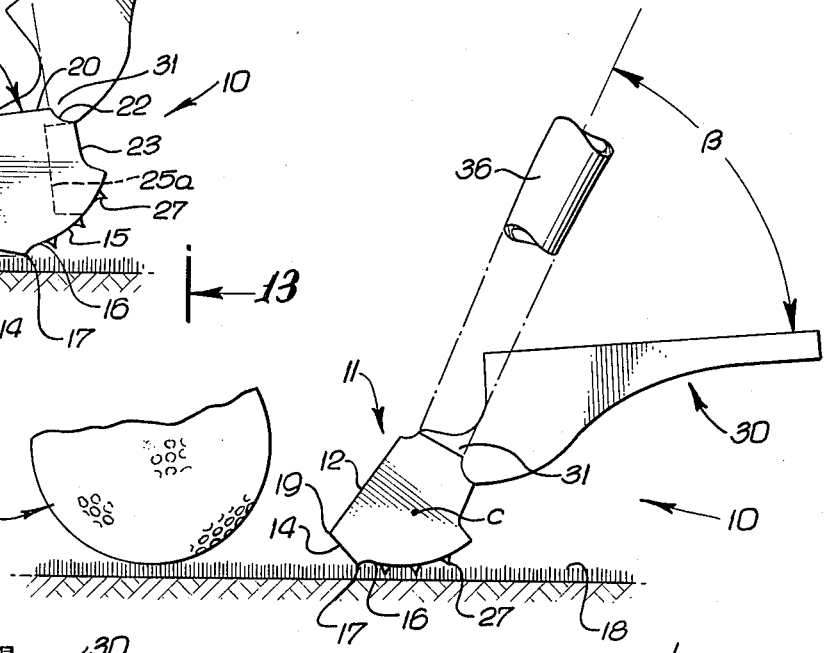
FIG. 10 is a view like FIG. 9, but showing the blade in tilted, aiming position.

Another important aspect of the invention concerns the provision of a putting path sighting device carried by the blade and projecting upwardly and rearwardly therefrom. For example, the sighting device 30 shown in FIGS. 9–13 is integral with the blade and mounted at 31 on the upper extent thereof so as to define a linearly elongated sighting groove or line 32. The latter extends upwardly and rearwardly in FIG. 1, and during blade tilting the line remains in an upright plane which perpendicularly intersects the planar front face 12. FIG. 10 illustrates the fact that the blade has a rearwardly tilted position in which the front face 12 is rearwardly inclined and elevated relative to the turf; also, the rear face 15 or the projections 27 which are a part thereof, support the blade and the device 30 extends rearwardly and substantially horizontally, so that the line 32 also extends substantially horizontally in a forward and rearward direction. The rearwardly lowered putter shaft appears at 36 extending at an angle $\beta$ above the sighting line 32. The player may then sight along line 32 (or along device 30) and aim the putter blade from directly behind the ball 13 in the direction of intended roll of the ball, eliminating guess work. Subsequently, he may lift the handle to putting position, thereby rotating the blade to FIG. 1 position, and accurately stroke the ball. As the putter is being rotated, the set direction of the blade remains established, due to the putter design.

Figure 11:
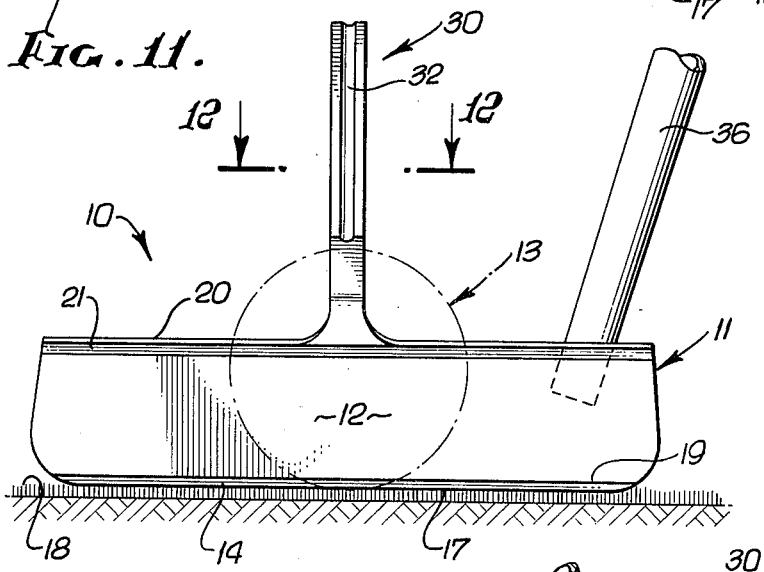
FIG. 11 is a frontal elevational view of the modified blade taken on lines 11—11 of FIG. 9.
Figure 12:
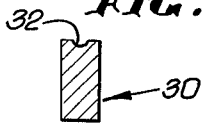
FIG. 12 is an enlarged section on lines 12—12 of FIG. 11.

In FIG. 11, the device 30 is shown to be mounted on the blade approximately mid-way or medially between transverse opposite ends of the blade. The device and blade may consist of a one-piece metal casting, for simplicity.

In the putter shown in FIGS. 1–4, the blade elements are given three digit numbers, the first digit being 1, and the second and third digits being the corresponding element numbers in FIGS. 9–13. One difference consists in locating the like sighting devices 130 in FIG. 4 at transverse ends of the blade. Also note that in FIG. 1 the blade surface 115' rests on the turf when the sighting device 130 is horizontal. Alternate shaped projections, corresponding to those at 127, are shown in FIGS. 5–8 at 127*a*, 127*b*, 127*c* and 127*d*.

I claim:

1. In a golf putter, the combination that comprises a. a shaft, a transversely horizontally elongated blade supported at one end of said shaft, said blade having a substantially vertical planar front face, a turf engaging bottom face located immediately rearwardly of the front face, and a rear face which extends arcuately rearwardly and upwardly above the level of said bottom face, said front face, bottom face and rear face each being transversely horizontally elongated, said rear face rotatably engaging the turf in blade supporting relation as the blade is tilted rearwardly, and b. a putting path sighting device carried by the blade and projecting angularly upwardly and rearwardly relative thereto, said blade having a rearwardly tilted position in which the front face is elevated, and said device extends rearwardly and substantially horizontally, c. there being projection means on the blade facing downwardly to engage the turf as the blade is tilted rearwardly, to prevent twisting of the blade during such tilting, said projection means carried by said transverse end portions of the blade, whereby the putter may be tilted rearwardly on said projection means, by tilting the shaft rearwardly and downwardly, and the sighting device brought into alignment relative to a cup on a green, and the putter may then be tilted back upwardly by tilting the shaft upwardly and forwardly to rotate the blade on the green turf and without twisting of the blade to bring the blade front face into aligned putting position.

2. The putter of claim 1 wherein said sighting device is mounted on upper extent of said blade and defines a linearly elongated sighting line which during blade tilting remains in an upright plane which perpendicularly intersects said planar front face.

3. The putter of claim 2 wherein said device is mounted on the blade approximately medially between transverse opposite ends thereof.

4. The putter of claim 2 wherein said device is mounted on at least one transverse end portion of the blade.

5. The putter of claim 2 wherein said blade and sighting device are defined by a one-piece metal casting.

6. The putter of claim 1 wherein said blade is recessed forwardly from said rear face intermediate transverse end portions of the blade.

7. In a golf putter, the combination that comprises a. a shaft, a transversely horizontally elongated blade supported at one end of said shaft, said blade having a substantially vertical planar front face, a turf engaging bottom face located immediately rearwardly of the front face, and a rear face which extends arcuately rearwardly and upwardly above the level of said bottom face, said front face, bottom face and rear face each being transversely horizontally elongated, said rear face rotatably engaging the turf in blade supporting relation as the blade is tilted rearwardly, and b. a putting path sighting device carried by the blade and projecting angularly upwardly and rearwardly relative thereto, said blade having a rearwardly tilted position in which the front face is elevated, and said device extends rearwardly and substantially horizontally, c. transverse end portions of the blade carrying turf engaging projections which taper outwardly of said rear face whereby the putter may be tilted rearwardly on said projections, by tilting the shaft rearwardly and downwardly, and the sighting device brought into alignment relative to a cup on a green, and the putter may then be tilted back upwardly by tilting the shaft upwardly and forwardly to rotate the blade on the green turf and without twisting of the blade to bring the blade front face into aligned putting position.

8. The putter of claim 1 wherein the center of mass of the blade remains approximately vertically above the zone of engagement of the rear face with the turf during such tilting.

9. The putter of claim 1 including a vertical step between the rearwardmost extent of the bottom face, and the forwardmost extent of the rear face, whereby the rear face is everywhere spaced above the rearwardmost extent of the bottom face.

* * * *